US011383257B2

(12) United States Patent
Liang et al.

(10) Patent No.: US 11,383,257 B2
(45) Date of Patent: Jul. 12, 2022

(54) ALL-PLASTIC SELF-LOCKING PUMP

(71) Applicant: MAJESTY PACKAGING SYSTEMS LIMITED, Zhongshan (CN)

(72) Inventors: Peihui Liang, Zhongshan (CN); Maoyong Zhu, Zhongshan (CN); Yonglei Zhang, Zhongshan (CN); Jinkao Liang, Zhongshan (CN)

(73) Assignee: MAJESTY PACKAGING SYSTEMS LIMITED, Zhongshan (CN)

( * ) Notice: Subject to any disclaimer, the term of this patent is extended or adjusted under 35 U.S.C. 154(b) by 0 days.

(21) Appl. No.: 17/268,426

(22) PCT Filed: Mar. 23, 2020

(86) PCT No.: PCT/CN2020/080656
§ 371 (c)(1),
(2) Date: May 27, 2021

(87) PCT Pub. No.: WO2021/164093
PCT Pub. Date: Aug. 26, 2021

(65) Prior Publication Data

US 2021/0291214 A1 Sep. 23, 2021

(30) Foreign Application Priority Data

Feb. 21, 2020 (CN) ..... 202010108603.9

(51) Int. Cl.
*B05B 11/00* (2006.01)

(52) U.S. Cl.
CPC ..... *B05B 11/3059* (2013.01); *B05B 11/3077* (2013.01)

(58) Field of Classification Search
CPC ..... B05B 11/3059; B05B 11/3077; B05B 11/3023; B05B 11/3047; B05B 11/3001; B05B 11/3042
See application file for complete search history.

(56) References Cited

U.S. PATENT DOCUMENTS 4,318,498 A * 3/1982 Magers ..... B67D 1/10 222/153.13
4,991,746 A * 2/1991 Schultz ..... A47K 5/1205 222/153.13

(Continued)

FOREIGN PATENT DOCUMENTS

CN 105966745 A 9/2016
CN 106005721 A 10/2016

(Continued)

OTHER PUBLICATIONS

International Search Report dated Nov. 25, 2020 in corresponding International Application No. PCT/CN2020/080656, translated search page, 5 pages.

(Continued)

*Primary Examiner* — Paul R Durand
*Assistant Examiner* — Bob Zadeh
(74) *Attorney, Agent, or Firm* — MH2 Technology Law Group LLP

(57) ABSTRACT

An all-plastic self-locking pump includes a pump body extending into a bottle, provided with a pump chamber and connected with a bottle locking cover, a suction assembly is arranged in the pump chamber, a check valve is arranged at a lower end of the pump chamber. A button is connected to an upper end of the suction assembly, a self-locking cover is arranged on the pump chamber, a plastic annular part is arranged in the pump chamber above the check valve, and an opening is formed in a side face of the plastic annular part. A locking mechanism is arranged between the button and the self-locking cover, and after the button is rotated to an unlocking position from a locking position, the button can be pressed to enable liquid in the bottle to be sprayed out of an outlet of the button.

11 Claims, 5 Drawing Sheets

(56) References Cited

U.S. PATENT DOCUMENTS

| | | | | | |
|---|---|---|---|---|---|
| 5,401,148 | A * | 3/1995 | Foster | B05B 11/0064 | 222/153.13 |
| 5,570,819 | A * | 11/1996 | Uehira | B05B 7/0037 | 222/190 |
| 5,615,806 | A * | 4/1997 | Grothoff | B05B 11/3023 | 222/153.13 |
| 5,899,363 | A * | 5/1999 | Bliss, III | B05B 11/307 | 222/153.02 |
| 6,065,647 | A * | 5/2000 | Bliss, III | B05B 11/0029 | 222/153.02 |
| 8,672,190 | B1 * | 3/2014 | Wang | B05B 11/0008 | 222/153.13 |
| 8,863,988 | B2 * | 10/2014 | Kang | B05B 11/3059 | 222/153.13 |
| 9,156,047 | B2 * | 10/2015 | Wang | B05B 11/3023 | |
| 2013/0200106 | A1 * | 8/2013 | Kang | B05B 11/3023 | 222/153.13 |
| 2021/0291214 | A1 * | 9/2021 | Liang | B05B 11/3077 | |

FOREIGN PATENT DOCUMENTS

| | | | | |
|---|---|---|---|---|
| CN | 106144189 | A | | 11/2016 |
| CN | 106144190 | A | | 11/2016 |
| CN | 205801924 | U | | 12/2016 |
| CN | 107051774 | A | | 8/2017 |
| CN | 207222190 | U | | 4/2018 |
| CN | 110723408 | A | * | 1/2020 |
| CN | 110723408 | A | | 1/2020 |
| JP | 3902297 | B2 | | 4/2007 |
| KR | 20090012318 | U | | 12/2009 |
| WO | 2013044698 | A1 | | 4/2013 |

OTHER PUBLICATIONS

Written Opinion dated Nov. 25, 2020 in corresponding International Application No. PCT/CN2020/080656, translated written opinion, 5 pages.

* cited by examiner

ALL-PLASTIC SELF-LOCKING PUMP

CROSS-REFERENCE TO RELATED APPLICATIONS

This application is a national stage filing under 35 U.S.C. § 371 of international application number PCT/CN2020/080656, filed Mar. 23, 2020, which claims priority to Chinese patent application No. 202010108603.9 filed Feb. 21, 2020. The contents of these applications are incorporated herein by reference in their entirety.

FIELD

The present disclosure relates to an all-plastic self-locking pump.

BACKGROUND

Emulsion pump, also known as push-type emulsion pump, is a liquid distributor which, based on atmospheric balance principle, pumps out liquid in a bottle by pressing, and refills the outside atmosphere into the bottle.

Due to exquisite design and convenient use, the emulsion pump has been widely used in daily chemical and pharmaceutical industries or the like. However, existing emulsion pump has many parts and a complex structure, and is difficult in manufacturing and high in production cost. Moreover, metal spring is used in the suction assembly of a traditional emulsion pump, which may directly contact with emulsion in a pump chamber. When the return spring rusts, the liquid may be polluted, thus being unsanitary. Moreover, button of the existing emulsion pump is easy to be mistakenly pressed during use, resulting in waste or inconvenience to a user.

The present disclosure is put forwarded based on the above shortcomings.

SUMMARY

The technical problem to be solved by the present disclosure is to provide an all-plastic self-locking pump, a plastic annular part is used, self-relaxation and contraction serve as an elastic force to replace a conventional metal spring to realize an all-plastic emulsion pump, and self-locking may implemented by rotating a button when not in use, thus being both environmentally friendly and sanitary.

In order to solve the above technical problem, the following technical solutions are used in the present disclosure. An all-plastic self-locking pump includes a pump body extending into a bottle, the pump body is provided with a pump chamber and connected with a bottle locking cover capable of fixing the pump body on the bottle, a suction assembly capable of moving up and down in the pump chamber to upwardly pump out a liquid in the bottle is arranged in the pump chamber, and a check valve only allowing the liquid in the bottle to be upwardly discharged when the suction assembly moves is arranged at a lower end of the pump chamber; a button capable of driving the suction assembly to operate is connected to an upper end of the suction assembly, a self-locking cover capable of preventing the suction assembly from separating from the pump chamber is arranged on the pump chamber, a plastic annular part capable of resetting the suction assembly after the suction assembly is pressed down is arranged in the pump chamber and located above the check valve, and an opening is formed in a side face of the plastic annular part; and positions where the button stays include a locking position and an unlocking position, a locking mechanism capable of preventing the button from moving downwardly when the button stays in the locking position is arranged between the button and the self-locking cover, and after the button is rotated to the unlocking position from the locking position, the button is capable of being pressed to enable the liquid in the bottle to be sprayed out of an outlet of the button.

According to the above all-plastic self-locking pump, the suction assembly includes a pump rod capable of penetrating through the self-locking cover and having a suction channel, the pump rod is provided with a liquid inlet communicating the suction channel with the pump chamber, a piston capable of sliding relative to the pump rod and sealing the liquid inlet is sleeved outside the pump rod, and a conical cap capable of extending into the plastic annular part is connected to a lower end of the pump rod.

According to the above all-plastic self-locking pump, the locking mechanism includes a positioning rib arranged on the button, the self-locking cover is provided with a platform capable of abutting against the positioning rib to prevent the button from moving downwardly, and an accommodating groove capable of accommodating the positioning rib when the button is rotated to the unlocking position.

According to the above all-plastic self-locking pump, an upper limit rib is arranged on the pump rod at an outer wall above the liquid inlet, a lower limit convex ring is on the pump rod at the outer wall below the liquid inlet, and the piston is located between the upper limit rib and the lower limit convex ring.

According to the above all-plastic self-locking pump, the lower end of the pump chamber is conical, and the check valve is a pump bead arranged at the lower end of the pump chamber.

According to the above all-plastic self-locking pump, a limit part capable of preventing the check valve from falling out and limiting the conical cap from moving down is arranged in the pump chamber and located above the check valve.

According to the above all-plastic self-locking pump, a liquid guide pipe is also arranged on the pump body and located below the check valve.

According to the above all-plastic self-locking pump, the plastic annular part is an elastic plastic annular part.

Compared with the related technology, the all-plastic self-locking pump of the present disclosure has the following technical effects.

According to the present disclosure, the plastic annular part capable of resetting the suction assembly after the suction assembly is pressed down is arranged in the pump chamber and located above the check valve, the plastic annular part is the elastic plastic annular part, and the opening is formed in the side face of the plastic annular part. When the lower end of the suction assembly extends into the plastic annular part, the opening is opened, and the whole plastic annular part is in an open state, and when the button is released, the plastic annular part is contracted due to a self-elasticity, and the opening is closed, and then the suction assembly is extruded upwardly. The plastic elastic part replaces a metal spring to realize elastic expansion and contraction, all parts are made of all-plastic materials, thus being energy-saving and environment-friendly, can be directly recycled without disassembly, thus having a high recycling efficiency and a wide application range.

BRIEF DESCRIPTION OF THE DRAWINGS

The specific embodiments of the present disclosure are further described hereinafter with reference to the accompanying drawings, wherein.

DETAILED DESCRIPTION OF THE EMBODIMENTS

Figure 1:
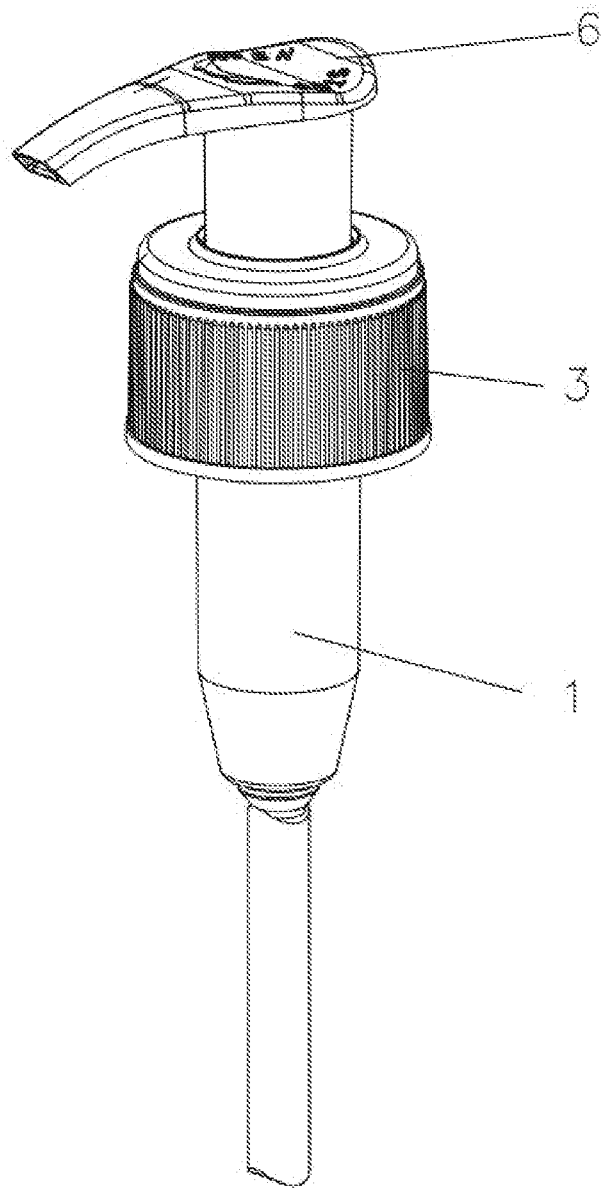
FIG. 1 is a stereoscopic diagram of the present disclosure.
Figure 2:
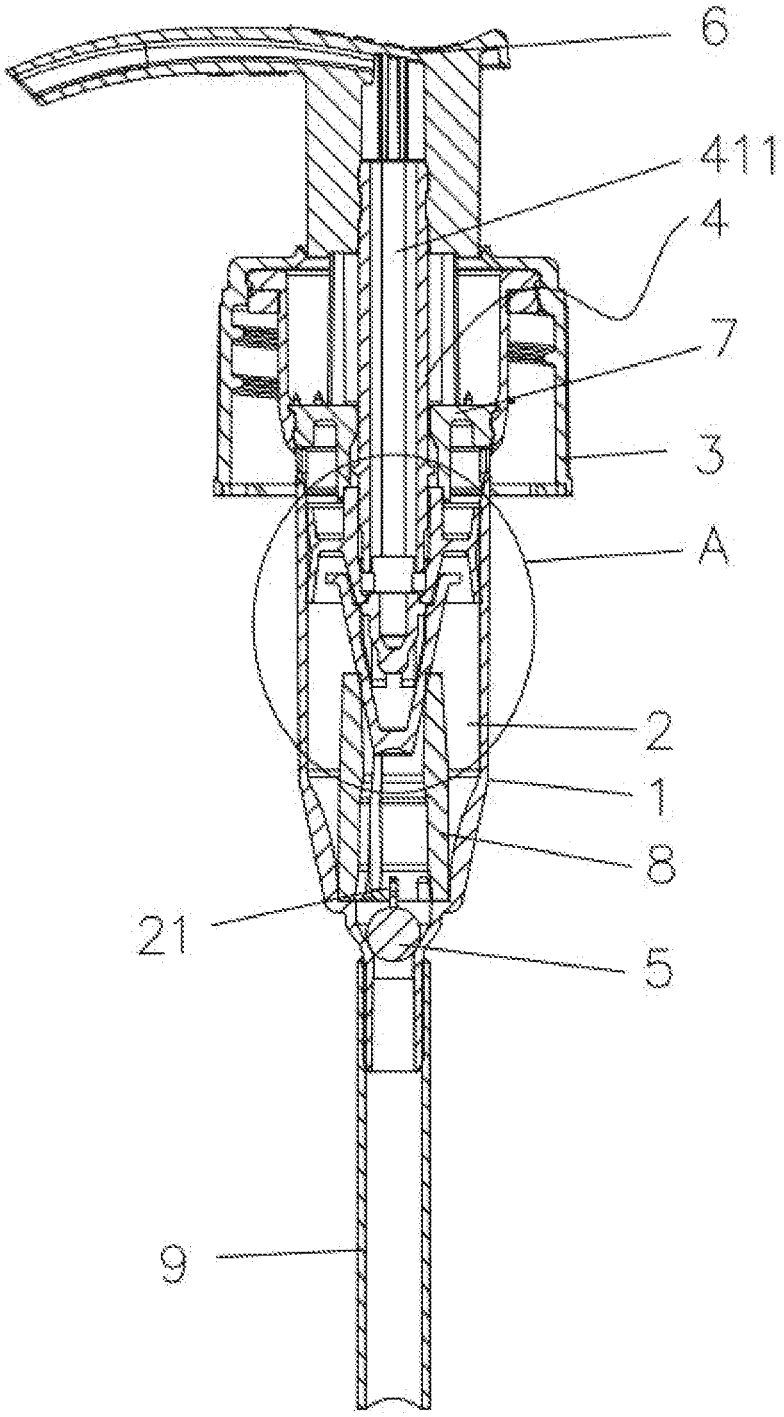
FIG. 2 is a cross-section view of the present disclosure.
Figure 3:
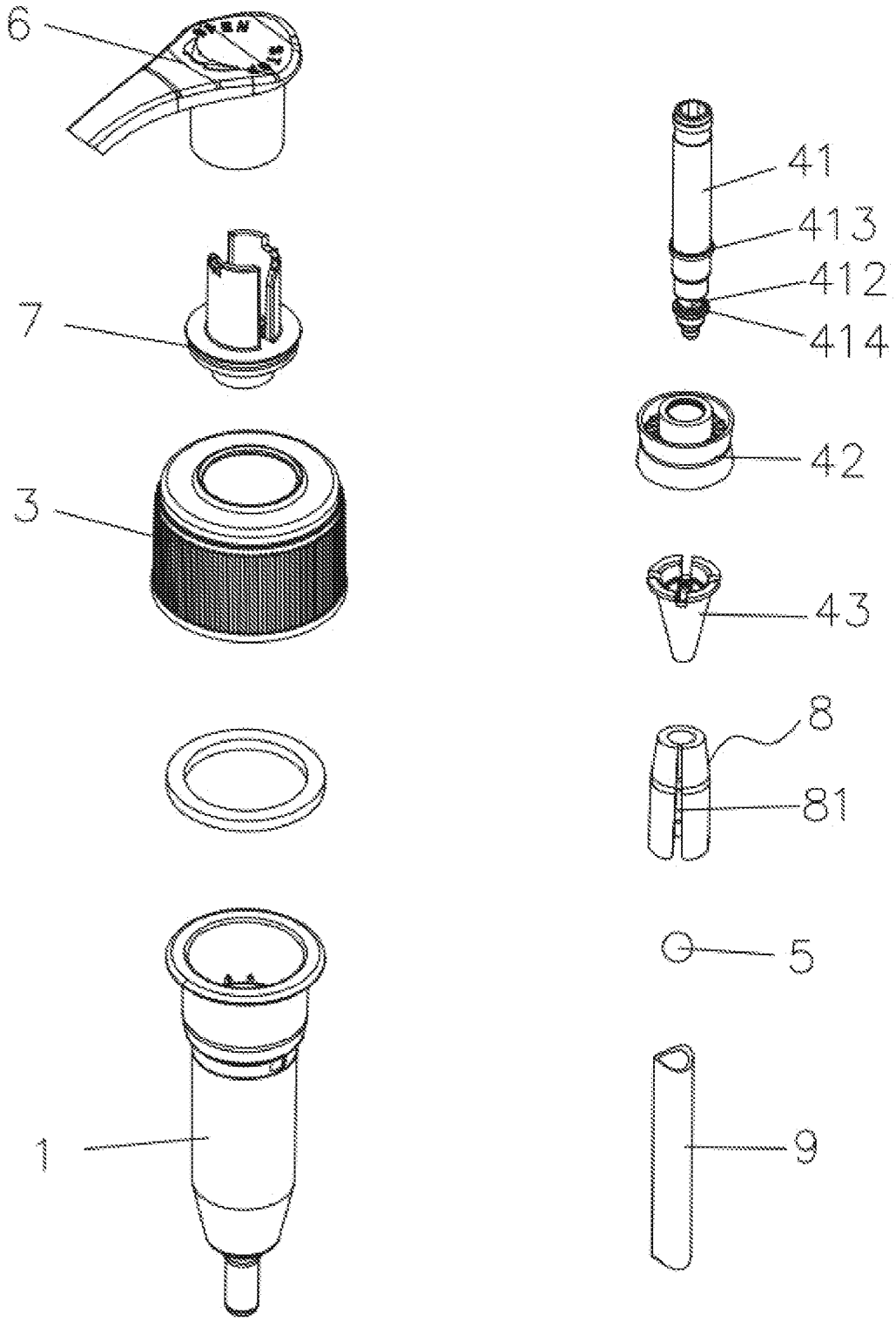
FIG. 3 is an exploded view of the present disclosure.
Figure 4:
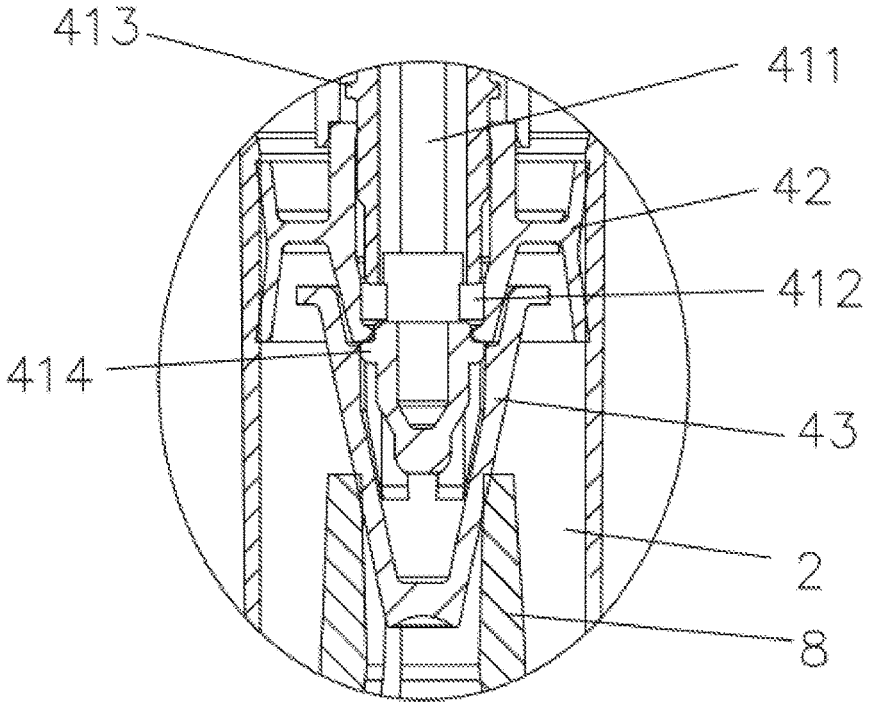
FIG. 4 is an enlarged view of part A in FIG. 2.
Figure 5:
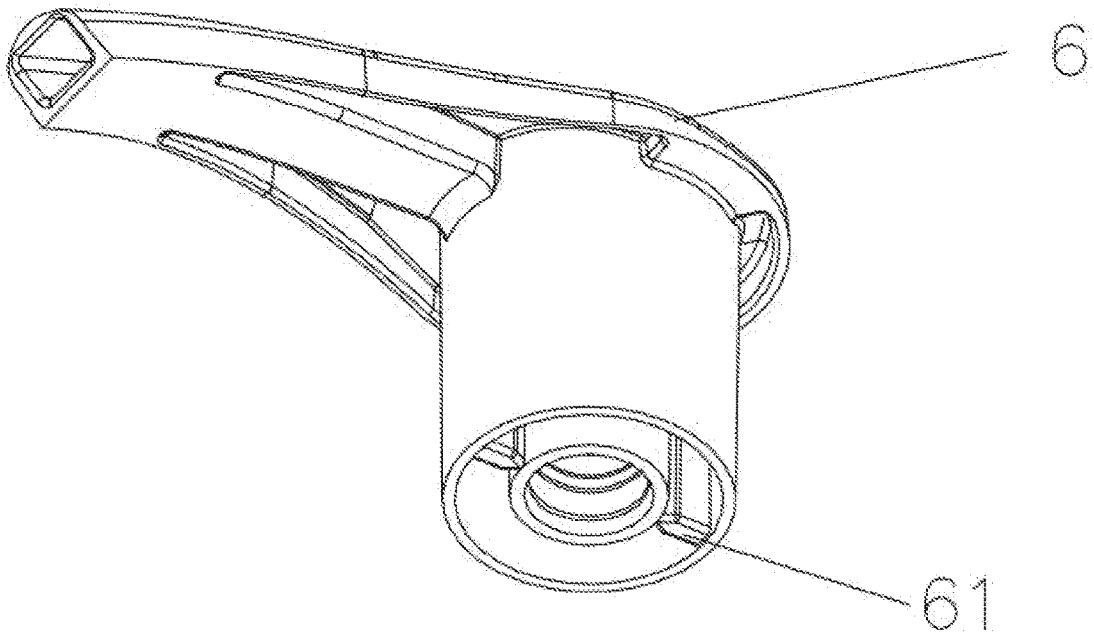
FIG. 5 is a stereoscopic diagram of a button of the present disclosure.
Figure 6:
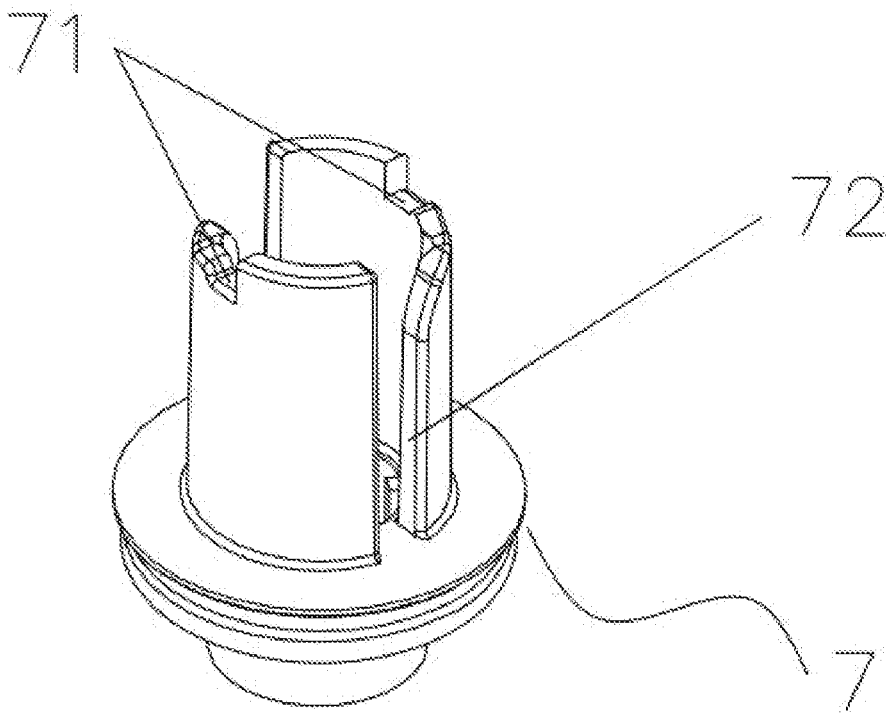
FIG. 6 is a stereoscopic diagram of a self-locking cover of the present disclosure.

The specific embodiments of the present disclosure are described in detail hereinafter with reference to FIG. 1 to FIG. 6. It shall be understood that what is shown in the drawings is only the preferred embodiments of the present disclosure, and does not constitute a limitation on the scope of the present disclosure. Those skilled in the art may make various obvious modifications, variations and equivalent substitutions on the basis of the preferred embodiments shown in the accompanying drawings, and on the premise of no contradiction, the technical features in the different embodiments described hereinafter may be combined, which fall within the scope of protection of the present disclosure.

As shown in FIG. 1 to FIG. 6, an all-plastic self-locking pump includes a pump body 1 extending into a bottle, the pump body 1 is provided with a pump chamber 2 and connected with a bottle locking cover 3 capable of fixing the pump body on the bottle, a suction assembly 4 capable of moving up and down in the pump chamber to upwardly pump out liquid in the bottle is arranged in the pump chamber 2, and a check valve 5 only allowing the liquid in the bottle to be upwardly discharged when the suction assembly 4 moves is arranged at a lower end of the pump chamber 2. A button 6 capable of driving the suction assembly 4 to operate is connected to an upper end of the suction assembly 4, so that the liquid in the bottle can be sucked out of the suction assembly by pressing the button, a self-locking cover 7 capable of preventing the suction assembly 4 from separating from the pump chamber 2 is arranged on the pump chamber 2, a plastic annular part 8 capable of resetting the suction assembly 4 after the suction assembly 4 is pressed down is arranged in the pump chamber 2 and located above the check valve 5, and an opening 81 is formed in a side face of the plastic annular part 8. Positions where the button 6 stays include a locking position and an unlocking position, a locking mechanism capable of preventing the button 6 from moving downwardly when the button 6 stays in the locking position is arranged between the button 6 and the self-locking cover 7, and after the button 6 is rotated to the unlocking position from the locking position, the button 6 is capable of being pressed to enable the liquid in the bottle to be sprayed out of an outlet of the button 6. In the embodiment, the plastic annular part is an elastic plastic annular part with a better elasticity, an upper end of the plastic annular part is bent inwardly, which can be fitted with a conical structure at a lower end of a pump rod, and the opening 81 formed in the side face of the plastic annular part enables the liquid coming out of the check valve to enter the pump chamber from the opening, and implements expansion and contraction of the plastic annular part at the same time. According to the present disclosure, the plastic annular part capable of allowing a lower end of the suction assembly to insert and resetting the suction assembly is arranged in the pump chamber and the opening is formed in the side face of the plastic annular part. When the lower end of the suction assembly extends into the plastic annular part, the opening is opened and the whole plastic annular part is in an open state. When the button is released, the plastic annular part is contracted due to a self-elasticity, and the opening is closed, and then the suction assembly is extruded upwardly. The plastic elastic part replaces a metal spring to realize elastic expansion and contraction, all parts are made of all-plastic materials, thus being energy-saving and environment-friendly, and having a wide application range. Meanwhile, since the positions where the button stays include the locking position and the unlocking position, the pump can be locked by rotating the button when not in use, so as to prevent liquid leakage caused by mistakenly pressing the button.

As shown in FIG. 1 to FIG. 6, in the embodiment, the suction assembly 4 includes a pump rod 41 capable of penetrating through the self-locking cover 7 and having a suction channel 411, the pump rod 41 is provided with a liquid inlet 412 communicating the suction channel 411 with the pump chamber 2, a piston 42 capable of sliding relative to the pump rod and sealing the liquid inlet 412 is sleeved outside the pump rod 41, and a conical cap 43 capable of extending into the plastic annular part 8 is connected to a lower end of the pump rod 41. By cooperation of the conical cap with the plastic annular part, contraction and expansion of the plastic annular part may be well implemented, thus being convenient for the pump rod to press down and reset.

As shown in FIG. 1 to FIG. 6, in the embodiment, the locking mechanism includes a positioning rib 61 arranged on the button 6, the self-locking cover 7 is provided with a platform 71 capable of abutting against the positioning rib 61 to prevent the button 6 from moving downwardly, and an accommodating groove 72 capable of accommodating the positioning rib 61 when the button 6 is rotated to the unlocking position. When the positioning rib on the button is rotated to a position corresponding to the accommodating groove of the self-locking cover, the button can be pressed down. When the positioning rib on the button is rotated to a position corresponding to the platform on the self-locking cover, the button is restricted from being pressed down as the platform abuts against the positioning rib, thereby realizing self-locking.

As shown in FIG. 1 to FIG. 6, in the embodiment, an upper limit rib 413 is arranged on the pump rod 41 at an outer wall above the liquid inlet 412, a lower limit convex ring 414 is on the pump rod 41 at the outer wall below the liquid inlet 412, and the piston 42 is located between the upper limit rib 413 and the lower limit convex ring 414. When the piston contacts with the upper limit rib 413, the liquid inlet 412 is in an open state, and when the piston contacts with the lower limit convex ring 414, the liquid inlet 412 is sealed by the piston.

As shown in FIG. 1 to FIG. 6, in the embodiment, the lower end of the pump chamber 2 is conical, and the check valve 5 is a pump bead arranged at the lower end of the pump chamber 2.

As shown in FIG. 1 to FIG. 6, in the embodiment, a limit part 21 capable of preventing the check valve 5 from falling out and limiting the conical cap 43 from moving down is arranged in the pump chamber 2 and located above the check valve 5. The limit part can prevent the pump bead from separating from the lower end of the pump chamber. Meanwhile, arrangement of the limit part can limit a pressing distance of the pump rod, so that the conical cap can be better matched with an annular structure of the plastic annular part, thereby realizing elastic expansion and contraction.

As shown in FIG. 1 to FIG. 6, in the embodiment, a liquid guide pipe 9 is arranged on the pump body 1 and located below the check valve 5.

As shown in FIG. 1 to FIG. 6, in the embodiment, the plastic annular part 8 is an elastic plastic annular part, which is convenient for self-contraction and expansion, replaces the spring to realize elastic resetting, and is made of an environment friendly material.

When in use, the button is rotated first to the unlocking position. Meanwhile, when the button is pressed down for the first time, the suction assembly moves downwardly along with the button. The piston presses gas in the pump chamber into the suction channel from the liquid inlet and discharges the gas, and at the moment, the pump chamber is in a negative pressure state. After releasing of a hand, the suction assembly moves upwardly under an elastic force of the plastic annular part. Since a pressure in the pump chamber is less than that in the bottle, the check valve is open, and the emulsion in the bottle enters the pump chamber. When an air pressure in the pump chamber is equal to that in the bottle, the check valve is closed, and the button is pressed again, so that the piston moves downwardly to squeeze the pump chamber. At the moment, the emulsion enters the suction channel from the liquid inlet and then flows out from the button.

The above embodiments are only the preferred solutions of the present disclosure, and the present disclosure may have other embodiments, such as reasonable combinations of the technical solutions recorded in several embodiments. Those skilled in the art may further make various equivalent modifications or substitutions without departing from the principle of the present disclosure, and these equivalent modifications or substitutions are all included in the scope defined by the claims of the present application.

The invention claimed is:

1. An all-plastic self-locking pump, comprising:

a pump body extending into a bottle, wherein, the pump body is provided with a pump chamber and connected with a bottle locking cover capable of fixing the pump body on the bottle, a suction assembly capable of moving up and down in the pump chamber to upwardly pump out a liquid in the bottle is arranged in the pump chamber, and a check valve only allowing the liquid in the bottle to be upwardly discharged when the suction assembly moves is arranged at a lower end of the pump chamber;

a button capable of driving the suction assembly to operate is connected to an upper end of the suction assembly, a self-locking cover capable of preventing the suction assembly from separating from the pump chamber is arranged on the pump chamber, a plastic annular part capable of resetting the suction assembly after the suction assembly is pressed down is arranged in the pump chamber and located above the check valve, and an opening is formed in a side face of the plastic annular part; and positions where the button stays comprise a locking position and an unlocking position, a locking mechanism capable of preventing the button from moving downwardly when the button stays in the locking position is arranged between the button and the self-locking cover, and after the button is rotated to the unlocking position from the locking position, the button is capable of being pressed to enable the liquid in the bottle to be sprayed out of an outlet of the button, and wherein the suction assembly comprises a pump rod capable of penetrating through the self-locking cover and having a suction channel, the pump rod is provided with a liquid inlet communicating the suction channel with the pump chamber, a piston capable of sliding relative to the pump rod and sealing the liquid inlet is sleeved outside the pump rod, and a conical cap capable of extending into the plastic annular part is connected to a lower end of the pump rod.

2. The all-plastic self-locking pump according to claim 1, wherein the locking mechanism comprises a positioning rib arranged on the button, the self-locking cover is provided with a platform capable of abutting against the positioning rib to prevent the button from moving downwardly, and an accommodating groove capable of accommodating the positioning rib when the button is rotated to the unlocking position.

3. The all-plastic self-locking pump according to claim 1, wherein an upper limit rib is arranged on the pump rod at an outer wall above the liquid inlet, a lower limit convex ring is on the pump rod at the outer wall below the liquid inlet, and the piston is located between the upper limit rib and the lower limit convex ring.

4. The all-plastic self-locking pump according to claim 1, wherein the lower end of the pump chamber is conical, and the check valve is a pump bead arranged at the lower end of the pump chamber.

5. The all-plastic self-locking pump according to claim 1, wherein a limit part capable of preventing the check valve from falling out and limiting the conical cap from moving down is arranged in the pump chamber and located above the check valve.

6. The all-plastic self-locking pump according to claim 1, wherein a liquid guide pipe is arranged on the pump body and located below the check valve.

7. The all-plastic self-locking pump according to claim 1, wherein the plastic annular part is an elastic plastic annular part.

8. An all-plastic self-locking pump, comprising:

a pump body extending into a bottle, wherein, the pump body is provided with a pump chamber and connected with a bottle locking cover capable of fixing the pump body on the bottle, a suction assembly capable of moving up and down in the pump chamber to upwardly pump out a liquid in the bottle is arranged in the pump chamber, and a check valve only allowing the liquid in the bottle to be upwardly discharged when the suction assembly moves is arranged at a lower end of the pump chamber;

a button capable of driving the suction assembly to operate is connected to an upper end of the suction assembly, a self-locking cover capable of preventing the suction assembly from separating from the pump chamber is arranged on the pump chamber, a plastic annular part capable of resetting the suction assembly after the suction assembly is pressed down is arranged in the pump chamber and located above the check valve, and an opening is formed in a side face of the plastic annular part; and positions where the button stays comprise a locking position and an unlocking position, a locking mechanism capable of preventing the button from moving downwardly when the button stays in the locking position is arranged between the button and the self-locking cover, and after the button is rotated to the unlocking position from the locking position, the button is capable of being pressed to enable the liquid in the bottle to be sprayed out of an outlet of the button, and wherein the locking mechanism comprises a positioning rib arranged on the button, the self-locking cover is provided with a platform capable of abutting against the positioning rib to prevent the button from moving downwardly, and an accommodating groove capable of accommodating the positioning rib when the button is rotated to the unlocking position.

9. The all-plastic self-locking pump according to claim 8, wherein the lower end of the pump chamber is conical, and the check valve is a pump bead arranged at the lower end of the pump chamber.

10. The all-plastic self-locking pump according to claim 8, wherein a liquid guide pipe is arranged on the pump body and located below the check valve.

11. The all-plastic self-locking pump according to claim 8, wherein the plastic annular part is an elastic plastic annular part.

* * * * *